US009719535B1

(12) United States Patent
Oehler et al.

(10) Patent No.: US 9,719,535 B1
(45) Date of Patent: Aug. 1, 2017

(54) VARNISH MITIGATION PROCESS

(71) Applicant: RelaDyne, LLC, Blue Ash, OH (US)

(72) Inventors: Daniel M. Oehler, West Chester, OH (US); Douglas James Muennich, Kings Mills, OH (US); David L. Wooton, Beaverdam, VA (US)

(73) Assignee: Reladyne, LLC, Blue Ash, OH (US)

( * ) Notice: Subject to any disclaimer, the term of this patent is extended or adjusted under 35 U.S.C. 154(b) by 0 days.

(21) Appl. No.: 15/231,998

(22) Filed: Aug. 9, 2016

Related U.S. Application Data

(60) Provisional application No. 62/203,171, filed on Aug. 10, 2015.

(51) Int. Cl.

| | |
|---|---|
| ***B08B 7/04*** | (2006.01) |
| ***F15B 21/00*** | (2006.01) |
| ***B08B 9/032*** | (2006.01) |
| ***B08B 3/14*** | (2006.01) |

(52) U.S. Cl.
CPC ..... *F15B 21/005* (2013.01); *B08B 3/14* (2013.01); *B08B 9/0321* (2013.01); *F15B 2211/865* (2013.01)

(58) Field of Classification Search
CPC .... F15B 21/005; F15B 2211/865; B08B 3/14; B08B 9/0321
See application file for complete search history.

(56) References Cited

U.S. PATENT DOCUMENTS

| | | | | |
|---|---|---|---|---|
| 5,788,827 | A * | 8/1998 | Munson | B03C 5/02 204/555 |
| 7,713,425 | B2 * | 5/2010 | Hanson | B01D 35/143 184/1.5 |
| 8,387,354 | B2 * | 3/2013 | Chillar | F01D 25/18 60/39.08 |
| 8,740,600 | B1 * | 6/2014 | Gomes | B03C 5/00 204/156 |

(Continued)

OTHER PUBLICATIONS

Fluitec:Boost VR (Varnish Removal). It's a safer and less expensive way of removing varnish and deposits from your lube system. Mar. 12, 2017, pp. 1-17.*

(Continued)

*Primary Examiner* — Bibi Carrillo
*Assistant Examiner* — Sharidan Carrillo
(74) *Attorney, Agent, or Firm* — Wood Herron & Evans LLP

(57) ABSTRACT

A method of flushing a hydraulic system including a fluid circuit and an in-service fluid flowing therein includes fluidly coupling a kidney loop to the fluid circuit such that at least a portion of the in-service fluid may flow therethrough, the kidney loop including a depth media filter and a micro-glass filter arranged in a parallel flow pattern and introducing a solvent cleaner into the in-service fluid at a concentration level between approximately 2.5% and approximately 6%, the solvent cleaner including at least one hydrocarbon group V fluid. The method further includes maintaining a temperature of the in-service fluid between (Continued)

approximately 100 degrees Fahrenheit and approximately 155 degrees Fahrenheit and controlling the flow of the in-service fluid at a flow rate between approximately 3 gallons per minute and approximately 6.8 gallons per minute.

11 Claims, 1 Drawing Sheet

(56) References Cited

U.S. PATENT DOCUMENTS

| | | | | |
|---|---|---|---|---|
| 2011/0041796 | A1* | 2/2011 | Sachdev | F01M 9/02 123/196 A |
| 2011/0089114 | A1* | 4/2011 | Livingstone | B01D 15/00 210/683 |

OTHER PUBLICATIONS

Annual Book of ASTM Standards, "Standard Guide for Cleaning, Flushing, and Purification of Steam, Gas, and Hydroelectric Turbine Lubrication Systems", vol. 05.01, 1999, 16 pages.
HYDAC Technology Corporation, "Technical Cleanliness Solutions Provider", vol. 10.14, 2014, 14 pages.
The Clark-Reliance Corporation, "Varnish Removal Systems (VRS)", 2013, 4 pages.
http://www.machinerylubrication.com, "Electrostatic Filter Helps Control Sludge and Varnish", 8 pages.
http://www.hyprofiltration.com, "Varnish Solutions for Lube Oil", 5 pages.
http://www.globalindustrialsolutions.net, "Varnish Mitigation Systems", 2 pages.
http://www.fluitec.com, "Fluitec Product Solutions: ESP Varnish Mitigation", 4 pages.

* cited by examiner

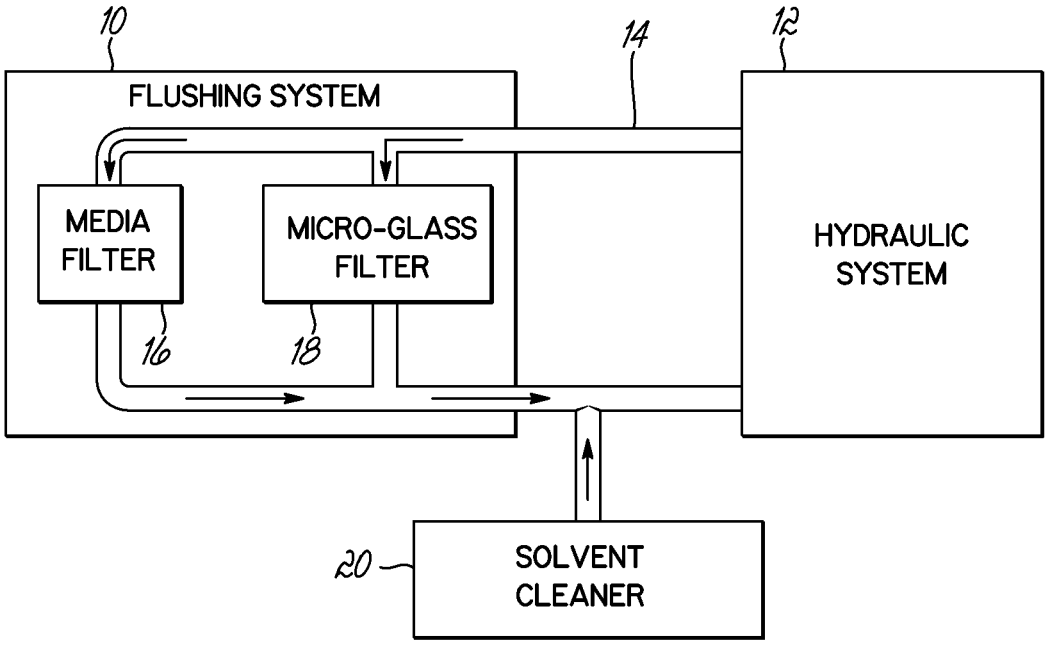
10
FLUSHING SYSTEM
14
12
MEDIA FILTER
MICRO-GLASS FILTER
HYDRAULIC SYSTEM
16
18
20
SOLVENT CLEANER

VARNISH MITIGATION PROCESS

RELATED APPLICATION

This application claims priority to U.S. Application No. 62/203,171, the entire contents of which is hereby expressly incorporated by reference herein.

BACKGROUND

Hydrocarbon lubricants, such as hydrocarbon oils, are susceptible to oxidation and varnish formation during normal operation of the lubricant systems. The petroleum industry over the years has eliminated most of the impurities from crude oil via hydrocracking or produced synthetic hydrocarbons to minimize oxidation problems later on. More recently, companies have developed varnish prediction test methods and varnish removal filters to filter out the soluble and insoluble varnish in lubrication systems. In spite of such efforts, it still becomes necessary after a period of time to address the problems associated with sludge and varnish. Further, varnish deposits onto machine parts causing the parts to stick and interfere with operation of a machine. This interference causes unplanned failures, downtime, and loss of equipment reliability.

Both draining and refilling a lubrication system and use of a varnish removal filtration system are expensive options and cannot guarantee that varnish is not deposited onto working machine parts. While there has been progress in slowing the oxidation process, predicting the varnish formation, and removing some of the varnish via filtration, varnish can only be removed by filtration if the oil makes its way back to the filter. Oil that is out in the lines of a lubrication system can continue to degrade and deposit varnish, causing problems with operation of machinery. One proposed solution is a hydrocarbon-based lubricant with polyether as described in U.S. Patent Application Publication No. 2013/0261035 or International Patent Application Publication No. WO 2013/148743, each of which is incorporated by reference in its entirety.

Further, today's modern machinery is designed for continuous operations. The stopping of a machine causes several problems for today's manufacturer. The interruption of production causes lost revenue and difficulty with machinery restarting. Manufactures are interested in a flushing technology which does not interfere with 24/7 production requirements. Scheduled downtime is very limited to the most critical maintenance practices and leaves little time for proper oil servicing. This has become very challenging with the typical oil flushing models developed through ASTM D6439, which is discussed below.

Today's modern machinery is designed for optimum speed and efficiencies. These machines have ability to measure their own performance through onboard sensors. These sensors may track system speed, temperature, part quality, and machine total output. Hydraulic and lubricating oils are key to system performance. The need to keep these highly sophisticated hydraulic systems free of contaminants is directly related to the total output of these machines.

The process of flushing a lubricant system requires the flow of a fluid—the current in-service fluid, a sacrificial flush fluid, or a modification of one of these two. The flushing process is defined by ASTM D6439 (Standard Guide for Cleaning, Flushing, and Purification of Steam, Gas, and Hydroelectric Turbine Lubrication Systems). According to ASTM D6439, there are 4 types of flushing approaches: displacement flush, high velocity flush, surface active cleaner flush, and solvent cleaners. A displacement flush utilizes a displacement flush oil of the same chemistry as the operating oil. System pumps and flow channels are utilized to circulate the displacement flush oil. Side stream filtration is recommended to improve flush effectiveness. Regarding high velocity flush, the primary requirement for successful oil flush is a high oil velocity, at least three to four times normal system velocity, within the system. Wherever possible, turbulent flow should be achieved in system pipes. A Surface Active Cleaner flush requires a cleaning solution to be added to the system as part of the flushing process. It also requires that this cleaning agent be completely removed before addition of new fluid. Solvent Cleaners utilize a solubilizing solvent be added to the operating fluid to aid in removal of the impurities. These solubilizing agents can be removed with the old fluid or maintained is the system after the flush has been completed, depending on their chemistry and the flushing operations.

The standard operation of flushing can apply heat and/or filtration during the flushing operation to aid in the cleaning process. Most often, the operations are performed by shutting-down the unit to be flushed down during the flush. This means the production operations of the unit can be down for 3-7 days. This is especially the case when the first three types of flushing operations are utilized. The current state of the art is to follow the D6439 Standard methodology. The problem with this is the down-time required. This is a very costly endeavor, and improvements or work-arounds are constantly being investigated.

SUMMARY OF THE INVENTION

A method of flushing a hydraulic system including a fluid circuit and an in-service fluid flowing therein includes fluidly coupling a kidney loop to the fluid circuit such that at least a portion of the in-service fluid may flow therethrough, the kidney loop including a depth media filter and a micro-glass filter arranged in a parallel flow pattern and introducing a solvent cleaner into the in-service fluid at a concentration level between approximately 2.5% and approximately 6%, the solvent cleaner including at least one hydrocarbon group V fluid. The method further includes maintaining a temperature of the in-service fluid between approximately 100 degrees Fahrenheit and approximately 155 degrees Fahrenheit and controlling the flow of the in-service fluid at a flow rate between approximately 3 gallons per minute and approximately 6.8 gallons per minute.

A method of flushing a hydraulic system including a fluid circuit and an in-service fluid flowing therein includes continuously cleaning the hydraulic system, wherein a kidney loop is fluidly coupled to the fluid circuit such that at least a portion of the in-service fluid may flow therethrough, the kidney loop including a depth media filter and a micro-glass filter arranged in a parallel flow pattern. A solvent cleaner is present in the in-service fluid at a concentration level between approximately 2.5% and approximately 6%, the solvent cleaner including at least one hydrocarbon group V fluid. A temperature of the in-service fluid is maintained between approximately 100 degrees Fahrenheit and approximately 155 degrees Fahrenheit. The flow of the in-service fluid is controlled at a flow rate between approximately 3 gallons per minute and approximately 6.8 gallons per minute.

A flushing system for flushing a hydraulic system including a fluid circuit and an in-service fluid flowing therein includes a kidney loop fluidly coupled to the fluid circuit such that at least a portion of the in-service fluid may flow therethrough, the kidney loop including a depth media filter and a micro-glass filter arranged in a parallel flow pattern. The flushing system further includes a solvent cleaner introduced into the in-service fluid at a concentration level between approximately 2.5% and approximately 6%, the solvent cleaner including at least one hydrocarbon group V fluid. A temperature of the in-service fluid is maintained between approximately 100 degrees Fahrenheit and approximately 155 degrees Fahrenheit. The flow of the in-service fluid is controlled at a flow rate between approximately 3 gallons per minute and approximately 6.8 gallons per minute.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

The FIGURE is a schematic of a flushing system for flushing a hydraulic system according to an embodiment of the present invention.

DETAILED DESCRIPTION

Measuring Efficacy of Hydraulic and Lubricating Systems.

To better understand the following description of embodiments of the present invention, the testing standards for measuring the efficacy of hydraulic and lubricating systems, as well as the effect of flushing time, are first described. The hydraulic and lubricating systems need to have proper testing done in order to qualify and quantify the contamination and varnishing problems. These tests are critical to identify the potential problems associated with system varnish. The same test is also used to quantify the success of the flushing procedure according to one preferred embodiment of the present invention. The MPC test is the cornerstone for varnish detection. The MPC test identifies the amount of insoluble precursors of varnish and soft contaminants in hydraulic and lubricating oils. However, there are other ASTM tests necessary to ensure the complete success of the process. The proper testing procedures should include ASTM D7843 (MPC), ASTM D7647/D7596 (Particle Count), and ASTM D6971 (RULER). Together, these tests provide a clear picture of the lubricants health and the machines ability to perform its specified task. Descriptions of these ASTM testing procedures are provided below.

ASTM D7843 (MPC).

The measuring criterion for successful completion of the flushing operation is ASTM D7843 (Standard Test Method for the Measurement of Lubricant Generated Insoluble Color Bodies in In-Service Turbine Oils using Membrane Patch Colorimetry), also called the MPC test. Adequate reduction of the MPC indicates removal/solubilization of the system varnish. If the process is operating correctly, the first turn-over of the tank should drop the MPC about 50%.

ASTM D7647 or D7596 (Particle Count).

Another criterion is particle count (ISO 4406—Hydraulic fluid power—Fluids—Method for coding the level of contamination by solid particles). Particle count is a standard, recognized measurement of the fluid contaminates. It defines how dirty the fluid is based on three ranges of particle size counting (4-micron, 6-micron and 14-microns). Dropping the particle count to the area of 16/14/11 or lower is desirable. To accomplish such a reduction means a 16 rating of particles less than 4-micron, a 14 rating less than 6-microns, and an 11 rating less than 14-microns is desirable.

ASTM D6971 (RULER).

The formulation of virtually every lubricant contains antioxidants. These antioxidants are designed to be sacrificial, meaning they oxidize before any other component of the lubricant thereby protecting it. This oxidative protection is the only thing saving the lubricant from premature failure. Remaining fluid life (RULER) of the fluid can be measured by monitoring the amount of antioxidants in lubricants. This analysis is based on voltammetric analysis as an electro-analytical method. The RULER technology is used as a trending tool for any lubricant application where antioxidants are used.

Flushing Operational Time.

One of the significant aspects of a flush is how long it takes to perform. This criterion determines how long the equipment is taken out of operation/production. This is a cost factor for the customer, because the operation is down for this period of time. If two jobs achieve the same cleanliness results, but one has achieved this faster, this one becomes the less costly for the customer. It is known that the standard downtime for a system flush of a hydraulic unit using a displacement flush is typically 2-3 days and often longer, costing the customer loss in $/day in profit. Thus, a process that reduces this downtime with the same results would be very valuable.

Embodiments of the invention relate generally to methods of maintaining hydraulic systems used in industrial manufacturing. Embodiments of the invention may be especially valuable to hydraulic systems that have small to medium fluid sump sizes (e.g., 100-800 gallon capacities). The average system is approximately 400 gallons. Exemplary applications include systems for plastic injection molding operations, paper machine operations, metal-rolling mills, compressors, and small turbine operations. The hydraulic fluid chemistry addressed is based on a hydrocarbon base fluid of the API Group I-IV. Examples are provided below to help illustrate the present invention, and are not comprehensive or limiting in any manner.

According to one aspect of the invention, there are four factors in the flushing operation that can be controlled to improve the cost effectiveness of the operation. These factors are flow, temperature, filter definition, and solvent cleaner. These four factors have previously showed minimal relationship to each other. Controlling these factors properly and together yields a cost/performance advantage over previous operations.

With reference to the FIGURE which shows one preferred embodiment of the invention, namely, a flushing system 10 for flushing a hydraulic system 12 includes a fluid circuit 14 and an in-service fluid flowing therein. The flushing system 10 includes a kidney loop fluidly coupled to the fluid circuit 14 such that at least a portion of the in-service fluid may flow therethrough. The kidney loop includes a depth media filter 16 and a micro-glass filter 18 arranged in a parallel flow pattern. The depth media filter may be a 1-micron depth media filter. The micro-glass filter may be a 1-micron 1000-beta micro-glass filter, a 3-micron 1000-beta micro-glass filter, a 5-micron 1000-beta micro-glass filter, and a 10-micron 1000-beta micro-glass filter. A solvent cleaner that includes at least one hydrocarbon group V fluid is introduced from a solvent cleaner source 20 into the in-service fluid at a concentration level between approximately 2.5% and approximately 6%. The solvent cleaner may include polyol esters, diesters, alkyl naphthalene, polyalkylene glycols, alkyl phthalate, cresols, terpenes, limonene, alkyl acetates, alkyl methacrylates, and combinations thereof. The solvent cleaner may include a dispersant. The dispersant may be polyisobutylene succinimide, polyisobutylene succinate ester, ethoxylated alcohols, polymethacrylates, polyalkylpyrrolidone, polyisobutylene mannich, and combinations thereof. The temperature of the in-service fluid is maintained between approximately 100° F. and approximately 155° F. The temperature of the in-service fluid may be maintained between approximately 105° F. and approximately 140° F. or at approximately 110° F. The flow of the in-service fluid is controlled at a flow rate between approximately 3 gpm and approximately 6.8 gpm. The flow of the in-service fluid may be controlled at a flow rate between approximately 4.5 gpm and approximately 6.0 gpm. According to the preferred embodiment, a method of flushing includes continuously removing a portion of the lube oil from the sump, filtering/cleaning it and returning it to the sump. The cleaned fluid then aids in the removal and transportation of the system contaminations (varnishes) to the cleaning operation. The method may further include monitoring the hydraulic system for leakage and introducing additional solvent cleaner in response to a detected leakage.

Flow Rate.

In a 400 gal capacity system, if the circulation flow rate is reduced from the standard of 10 gpm to 3-5 gpm, the flush reaches a completion value in only 24 hours instead of the typical 3 days previously required. When operating at this flow rate, the tank is turned-over every hour to hour-and-half. This means 18 to 24 tank turnovers are achieved in the 24 hour operation. If the flow is operated too slowly, the operation also will take too long to complete, based on insufficient sump turnover rates. Less than 10-12 tank turnovers have been determined to not be sufficient to properly clean the system. If the flow rate is too fast, the fluid removed from the tank doesn't have sufficient resonance time in the cleaning procedure to be properly cleaned—thus is returned to the tank still dirty where it cannot aid in the cleaning process. There seems to be an optimum flow rate, and it also seems that the optimum flow-rate is not fast enough to neither generate turbidity nor increase in Reynolds numbers. Solubility and filtration is the key function. This conclusion is borne out by the fact that customers who used the present invention, observed the fluid temperature—which dropped an average of 7-10° F., with one example showing a drop of −30° F. This means improved heat/cooling exchanger operation with moving parts and valves proper cleaned of varnishes.

Reduction of Failed Components.

Varnish in the fluid has the ability to come out of solution anywhere the hydraulic or lubricating fluid goes. One of the prime uses of the fluid is to work with the actuators and valve of the machine, which are often the most sensitive components in a machine. If the varnish interferes with these components, serious operational issues develop. Many operators consider the interfering of the valve and actuator by varnish as a component failure because they may not have the technology to remove the varnish to restore this mechanical component. Removing the varnish is therefore a means of reducing component failures.

Example—Reduction of Failed Servo Valves.

The system being cleaned was a Husky 2000-ton injection molding machine—MPC=60 dE (October, 2014). This particular system had failures on main clamp hydraulic valve on a weekly basis. The failed components were sent to a rebuilder for a root cause analysis, which identified "varnish" as the main cause for failure. Subsequently, a Rela-Dyne Varnish Mitigation process was completed on the Husky 2000-ton machine. The fluid was cleaned to the normal rating for MPC (14 dE). There was an immediate change in clamp valve hysteresis. The inline pressure to the clamp valve was reduced to the "original" setting. No valve failures were observed for 8 months of operating the machine after the varnish mitigation process. The cost of rebuilding each clamp valve was costing $3500 plus loss of production. Thus, it is estimated that the varnish mitigation process of the present invention resulted in a savings to the customer of $112,000 dollars on rebuild and a gain of 128 additional production hours.

Production Cost Improvements.

Production cost is an important measurement of any operation. It includes material costs, operational costs, product output volumes and downtime together. Equipment reliability and production output become important in this measurement. The most effective way to improve production cost is not to acquire cheaper raw materials but, rather, to speed up output of the product at the same operational costs. This can be achieved through reliability and performance enhancements of the production machinery. Exemplary production cost improvements include improvements in moving parts and valves operations without the varnish present. This shortens the machine cycle time. These parts are known to stick, causing response slow-downs and operational reliability and output issues.

Example—Production Cost Improvement.

As an example of the benefits of the present invention, one customer used the flush process described herein in combination with a plastic injection molding machine. This resulted in a decrease in output cycle time. from 18 seconds per product to 17 seconds per product, thereby reflecting a total cost improvement of $6-7M/year for this machine.

Example—Maintenance Cost Reduction.

A parallel comparison was made using a conventional flush process and the flush process described herein on two identical machines operating in parallel. Both machines were cleaned to the same MPC value. The customer observed that the machine cleaned with the process described herein appeared to work better, and the operator reportedless pump noise (clatter/chatter), and less vibration. These observations indicate that, with the present invention, less pump wear is occurring and as a result the life expectancy of the pump will be extended.

Process Flow Rate Vs. Performance—High Process Flow Rate.

Fluid Flow versus Performance was studied to define an optimum flow requirement for flushing performance. There is a maximum and minimum flow range. (March, 2015). The system being cleaned was a Milacron 950-ton Injection molding machine, and the operating temperature of the hydraulic oil was 120° F.–MPC=75 dE. An 11×44-inch Depth Media Filter was employed. The fluid flow rate through the Depth Media Filtration housing started at 6.5 gpm. The process began with monitoring the MPC every 2 hours. It was observed after 12 hours that the MPC numbers had only dropped 5 points to 70 dE. This flow rate was dropped to 4.5 gpm. The MPC was continued to be monitored every 2 hours. The MPC started dropping approximately 10 points every 2 hours until it reached normal rating for MPC (12 dE).

Process Flow Rate Vs. Performance—Low Process Flow Rate.

Fluid Flow versus Performance was studied to define an optimum flow requirement for flushing performance. There is a maximum and minimum flow range. (January, 2015).

The system being cleaned was a Husky 200-ton Injection molding machine, and the operating temperature of the hydraulic oil was 110° F.–MPC=60 dE. An 11×44-inch Depth Media Filter was employed. The fluid flow rate through the Depth Media Filtration housing started at 3.5 gpm. The process began with monitoring the MPC every 2 hours. It was observed after 12 hours that the MPC numbers had only dropped 10 points to 50 dE. This flow rate was increased to 6.0 gpm. The MPC was continued to be monitored every 2 hours. The MPC dropped approximately 15 points in the first 2 hours. The flow rate was continued for at 6.0 gpm for another 8 hours until it reached normal rating for MPC (10 dE).

Temperature.

Applicant has determined that temperature is another important parameter. As one heats a fluid the solubility of the varnishes becomes more soluble. Therefore heating the fluid aids in the cleaning operation. However, if one heats the fluid too high the additive system within the fluid decomposes. Applicant has found that a temperature of 110° F. is optimum for good solubility of the varnishes and not too hot for the additive system.

Temperature Vs. Performance (Bulk Oil Temperature)—High Process Temperature.

Temperature versus Performance was studied to define an optimum temperature requirement for flushing performance. There is a maximum and minimum temperature range. (February 2015). The system being cleaned was a Milacron 150-ton injection molding press, and the operating temperature of the hydraulic oil was 155° F.–MPC=95 dE. The process began with monitoring the MPC every 2 hours. It was observed after 12 hours that the MPC numbers had only dropped 20 point to 75 dE. The process was continued for an additional 8 hours without change of the MPC. The temperature of the fluid being cleaned was dropped to 140° F. After 4 hours, the MPC dropped to 30 dE. After 10 hours of processing, the MPC dropped to normal rating for MPC (15 dE).

Temperature VS Performance (Bulk Oil Temperature)—Low Process Temperature.

Temperature versus Performance was studied to define an optimum temperature requirement for flushing performance. There is a maximum and minimum temperature range. (January, 2015). The system being cleaned was a Nessie 150-ton Injection molding press machine, and the operating temperature of the hydraulic oil was 100° F.–MPC=55 dE. The process began with monitoring the MPC every 2 hours. It was observed after 12 hours that the MPC numbers had only dropped 4 point to 51 dE. The process was continued for an additional 8 hours without change of the MPC. The temperature of the fluid being cleaned was raised to 110° F. After 2 hours, the MPC dropped to 20 dE. After 6 hours of processing, the MPC dropped to normal rating for MPC (10 dE).

Filtration System.

The use of a filter as part of this operation is for the removal of both hard and soft contamination particles. Particles in the fluid are known as hard particles when they primarily consist of non-organic components. Many of these are sourced in wear debris, dirt ingress and additive decomposition materials. Soft particles in the fluids are components formed from fluid degradation—both additive and base stock combined. The hard particles are typically not soluble in the fluid being cleaned. That makes them relatively easier to remove through conventional particulate filtration. The size of these therefore relates to the required micron pore size of the filter being used for this filtration process. This defines one of the filters chosen for this invention. The soft contaminates have an ability to be both soluble and insoluble in the processed fluid. Therefore to remove them a choice of the filtration media and cleaning process needs to account for both types.

Applicant has learned that optimum performance depends on using the correct filter system. And in addition, use of the correct filter system is a controllable factor, because of the variation of filters that may be available. Because the fluid is being cycled from the tank to be cleaned and returned to the tank, external fluid cleaning equipment is available for this cleaning process. Several cleaning methods have been found to work for this kidney-loop application. One can use electrostatic filters, charge agglomeration filters, depth media filters, conventional fluted filters, ion exchange filters, and water absorbance filters. It has been determined that many of these filters can be used successfully singularly or in combinations.

However, it has also been determined that the best practice is to use a deep pile filter combined with a beta-1000, 1-micron micro-glass filter. We have found that the process works better using the 1-micron than a 3- or 5-micron micro-glass.

Depth Media Filter Vs. No-Depth Media Filtration (with 1-Micron Micro-Glass Filter).

Differences observed with filter modified operations were measured in the cleaning speed to obtain similar changes in ASTM D7843 (MPC) values. The use of a depth filter yielded a MPC reduction not observed without this type filter employed, even though reduction in particle count was observed by both operational procedures. The system being cleaned was a Engel 300-ton injection molding machine—MPC 62-67 dE on both systems (September, 2014). Using a 1-micron beta 1000 filter cleaned oil for 72 hours to achieve an ISO particle count of 12/10/8. However, after 72 hours of filtration the MPC rating was 66 dE. Using a 1 micron beta 1000 filter and a depth filter media filtration yielded a cleaning time of 24 hours to achieve normal rating for MPC rating (10-18 dE) and an ISO particle count of 12/10/8.

1-Micron Versus 3-Micron Micro-Glass Filter.

The use of a 1-micron micro-glass filter yielded a 40% reduction of process-operational time over that using a 3-micron micro-glass filter. The system being cleaned was a Engel 300-ton injection molding machine—MPC 62-67 dE on both systems (October, 2014). Using a 3-micron beta 1000 filter and depth filter media filtration yielded a cleaning time of 40 hours to achieve normal MPC rating (10-18 dE). Using a 1-micron beta 1000 filter and a depth filter media filtration yielded a cleaning time of 24 hours to achieve normal rating (10-18 dE).

3-Micron Vs. 5-Micron Micro-Glass Filter.

The use of a 3-micron micro-glass filter yielded a 20% reduction of process-operational time over that using a 5-micron micro-glass filter. The system being cleaned was a Engel 300-ton injection molding machine—MPC 62-67 dE on both systems (October, 2014). Using a 3-micron beta 1000 filter and depth filter media filtration yielded a cleaning time of 40 hours to achieve normal MPC rating (10-18 dE). Using a 5 micron beta 1000 filter and a depth filter media filtration yielded a cleaning time of 48 hours to reduce the MPC value to the normal MPC rating (10-18 dE).

Solvent Cleaners.

Solvent cleaners are known to be a value in the flush process. Determining the optimum cleaning solvent typically requires both experience and experimentation, with a full understanding of the operational needs and the process.

Cleaner formulations based on embodiments of the present invention are uniquely beneficial to operational needs and process experience.

Competitor products (such as Mobil System Cleaner, Castrol Detergen System Cleaner and Shell Industrial System Cleaner) cause failing demulsibility to the point where equipment reliability is in danger. Mobil reports that the addition of Mobil System Cleaner at 0.1% will cause failing demulsibility. The suppliers of these competitor fluids do not recommend continuing equipment operations while utilizing these Flushing aids.

Many times, the use of a detergent additive for flush aids can cause demulsibility issues of the hydraulic fluid (measured by ASTM D1401—Standard Test Method for Water Separability of Petroleum Oils and Synthetic Fluids). When using the RELATECH-VM product at 3-5% dosages, the demulsibility issues range from minimal to non-existent and the product performs as desired. Based on the operations of these systems, where there is a continuous fluid leakage or replacement is occurring, the added flush aid (RELATECH-VM) is slowly replaced after the flush has been completed by new fluid in what is called a Bleed & Feed operation. This facilitates purging the Flush Aid from the system after it has completed it job.

The use of these type cleaners has a secondary issue of releasing the varnish components too rapidly. Within the lubricant system when the fluid is aged, varnish components are known to be collected in many locations around the system. The volume of these varnish components can be very excessive. It has been found that the addition of many of these commercial system cleaners loosens the varnish to allow it to float around the system freely. In doing so there is a tendency for these loose varnish particles to collect or be trapped in an expensive actuators or valves (critical machine components). Some of these valves cost in excess of $10,000 along with the down-time cost, making this an expensive reliability issue.

Applicant has learned that there are advantages over previous operation by either using a solvent cleaner that is defined as a Group V fluid or a solvent cleaner that includes dispersant additive chemistry in a hydrocarbon or Group V fluid. The best-performing cleaner was a combination of these two solvent cleaners into a single fluid. An example of the Group V solvent cleaner is sold by Fluitec, International as BOOST VR, however other similar type products could also be utilized with variable advantages. The optimized, combined solvent cleaner is also sold by Fluitec, International as BOOST DW. This product is also defined as RELATECH-VM.

Use During Operation.

In accordance with the principles of the present invention, the exemplary process was a 24-hour operation, which allowed the customer to continue the normal operation during the flushing process. Thus, the customer does not experience down-time loss in its production during the flushing operations.

Comparison of a Major Oil Company System Cleaner.

The use of a Commercial System Cleaner was shown to cause serious reliability issues. The system being cleaned was a Husky 500-ton Injection molding machine MPC=45 dE (December, 2014). A 5% system cleaner was introduced into the hydraulic system to remove varnish from the system. The machine was run for 24 hrs, and the fluid was drained. A sacrificial flush fluid was introduced to circulate and attempt to remove the flushing agent, which caused the machine to be down for 4 hours. The machine was restarted and began to have immediate show problems of plugging filters and failing valves. It showed an end of process MPC=30 dE. Two weeks after the flushing process, the machine was still having valve failing issues.

Relatech-VM Cleaning System.

It has been observed that the use of the Solvent Cleaner results in an accelerated process for cleaning the metal surfaces. Similar systems were cleaned using RELATECH-VM to show that, although the MPC values were equivalent, the parts using Solvent Cleaner System were visually cleaner.

Relatech-VM Cleaning System.

The use of RELATECH-VM for aid in cleaning varnish from a system was shown to correct the issues of actuator or valve issues. The system being cleaned was a Husky 500-ton Injection molding machine MPC=96 dE (November, 2014). RELATECH-VM was added at 3% to the in-service fluid. It was circulated during operation for 24 hours—during which the machine was producing product uninterrupted. It showed an end of process MPC=11 dE. The machine picked up 0.2 sec/cycle for a 6-second cycle time during the cleaning process. Annualized, this improvement was calculated to be $28,000 worth of increased product for this machine.

While specific embodiments have been described in considerable detail to illustrate and explain the present invention, the description is not intended to restrict or in any way limit the scope of the appended claims to such detail.—In other words the invention—is not limited to the specific details, representative apparatus and methods and illustrative examples shown and described herein. Rather, additional advantages and modifications will readily appear to those skilled in the art. Accordingly, departures may be made from such details without departing from the scope of the general inventive concept.

We claim:

1. A method of flushing a hydraulic system comprising the steps of:

connecting a flushing system to a hydraulic system, the flushing system comprising a fluid circuit and an in-service fluid flowing therein;

fluidly coupling a kidney loop to the fluid circuit such that at least a portion of the in-service fluid flows there through and to the hydraulic system, the kidney loop including a depth media filter and a micro-glass filter arranged in a parallel flow pattern;

flushing the hydraulic system by introducing the solvent cleaner into the kidney loop such that the solvent cleaner mixes with the in-service fluid of the kidney loop, the solvent cleaner having a concentration level between approximately 2.5% and approximately 6% and being selected from the group consisting of polyol esters, diesters, alkyl naphthalene, polyalkylene glycols, alkyl phthalate, cresols, terpenes, limonene, alkyl acetates, alkyl methacrylates, and combinations thereof;

maintaining a temperature of the in-service fluid between approximately 100 degrees Fahrenheit and approximately 155 degrees Fahrenheit; and controlling the flow of the in-service fluid at a flow rate between approximately 3 gallons per minute and approximately 6.8 gallons per minute.

2. The method of claim 1, wherein controlling the flow of the in-service fluid includes controlling the flow of the in-service fluid at a flow rate between approximately 4.5 gallons per minute and approximately 6.0 gallons per minute.

3. The method of claim 1, wherein maintaining the temperature of the in-service fluid includes maintaining the temperature of the in-service fluid between approximately 105 degrees Fahrenheit and approximately 140 degrees Fahrenheit.

4. The method of claim 1, wherein the depth media filter is a 1-micron depth media filter.

5. The method of claim 1, wherein the micro-glass filter is selected from the group consisting of a 1-micron 1000-beta micro-glass filter, a 3-micron 1000-beta micro-glass filter, a 5-micron 1000-beta micro-glass filter, and a 10-micron 1000-beta micro-glass filter.

6. The method of claim 1, wherein the solvent cleaner includes a dispersant.

7. The method of claim 1, further comprising removing a portion of the in-service fluid.

8. The method of claim 1, further comprising monitoring the hydraulic system for leakage.

9. The method of claim 3, wherein maintaining the temperature of the in-service fluid includes maintaining the temperature of the in-service fluid at approximately 110 degrees Fahrenheit.

10. The method of claim 6, wherein the dispersant is selected from the group consisting of polyisobutylene succinimide, polyisobutylene succinate ester, ethoxylated alcohols, polymethacrylates, polyalkylpyrrolidone, polyisobutylene mannich, and combinations thereof.

11. The method of claim 8, further comprising introducing additional solvent cleaner in response to a detected leakage.

* * * * *